United States Patent [19]

Crépaux et al.

[11] 4,197,283

[45] Apr. 8, 1980

[54] CARBON FIBRES

[75] Inventors: Alain Crépaux, Lavera; Anne-Marie Moutard, Paris; Albert Bonzom, Sausset les Pins, all of France

[73] Assignee: The British Petroleum Company Limited, Sunbury-on-Thames, England

[21] Appl. No.: 903,678

[22] Filed: May 8, 1978

[30] Foreign Application Priority Data

May 25, 1977 [FR] France ..... 77 15991

[51] Int. Cl.[2] ..... D01F 9/14

[52] U.S. Cl. ..... 423/447.4; 264/29.2; 423/447.1; 423/447.2; 423/447.6

[58] Field of Search ..... 423/447.1, 447.4, 447.7, 423/447.2, 447.6, 447.8; 264/29.2

[56] References Cited

U.S. PATENT DOCUMENTS

| | | | |
|---|---|---|---|
| 3,629,379 | 12/1971 | Otani | 423/447.6 |
| 3,702,054 | 11/1972 | Araki et al. | 423/447.6 |
| 3,718,574 | 2/1973 | Araki et al. | 208/44 |
| 4,115,527 | 9/1978 | Otani et al. | 423/447.4 |

FOREIGN PATENT DOCUMENTS

| | | | |
|---|---|---|---|
| 1310769 | 3/1973 | United Kingdom | 423/447.1 |

*Primary Examiner*—Edward J. Meros

*Attorney, Agent, or Firm*—Morgan, Finnegan, Pine, Foley & Lee

[57] ABSTRACT

The invention relates to a process for the manufacture of carbon or graphite fibres which comprises spinning a petroleum pitch having a $\beta$ resin content of between 5 and 40%, and carbonizing the resultant fibres by heating. The pitch may have a $\delta$ resin content of between 10 and 20% and an $\alpha$ resin content of less than 1%. It may be produced by distilling and ageing the residue from the steam cracking of a petroleum fraction, particularly a naphtha fraction.

The fibres may be given a surface oxidation between the spinning and carbonization stages.

These fibres may be used in the reinforcement of plastic materials.

19 Claims, 1 Drawing Figure

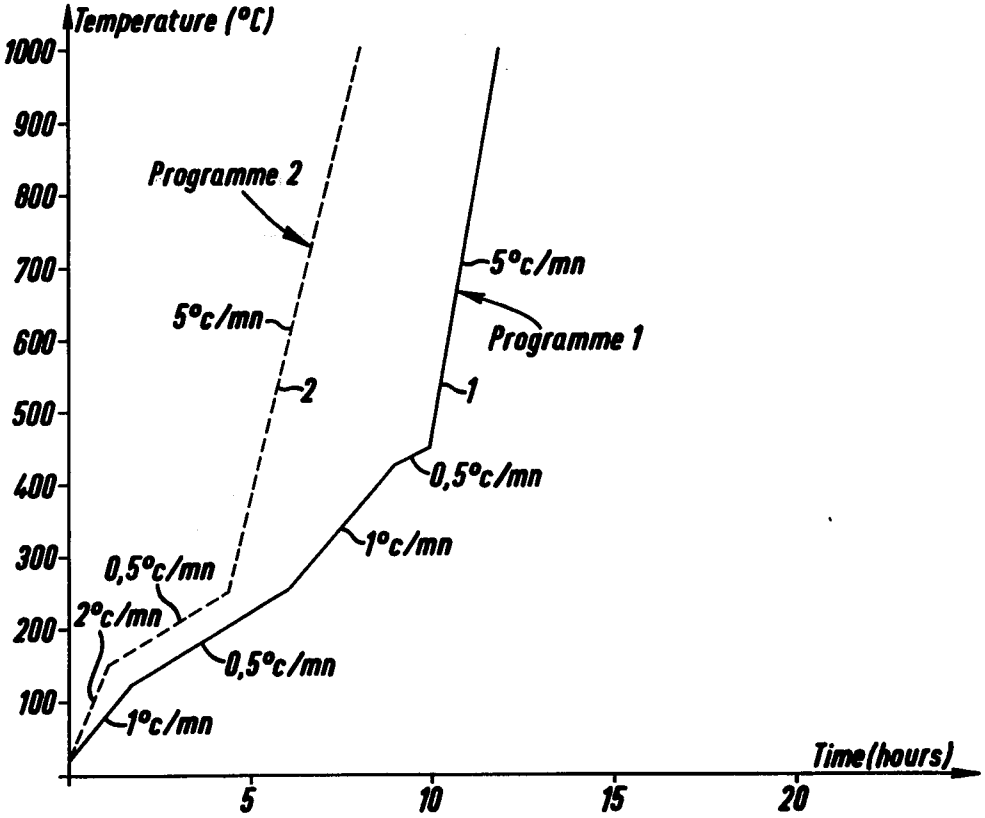
Temperature (°C)
1000
900
800
700
600
500
400
300
200
100
Programme 2
5°c/mn
2
0,5°c/mn
2°c/mn
5°c/mn
Programme 1
1
0,5°c/mn
1°c/mn
0,5°c/mn
1°c/mn
5
10
15
20
Time (hours)

CARBON FIBRES

The present invention relates to the manufacture of carbon fibres from products derived from petroleum.

Carbon fibres at present marketed may be classified into three categories: (1) the classic fibres having a tensile strength (R) and a mean elasticity modulus (E) such that R is approximately equal to 210 kgf/mm$^2$ and E is equal to approximately 22,000 kgf/mm$^2$, (2) the high-strength fibres in which R is equal to approximately 250 kgf/mm$^2$ and E is equal to approximately 26,000 kgf/mm$^2$ and (3) the high-modulus fibres in which R is equal to approximately 195 kgf/mm$^2$ and E is equal to 40,000 kgf/mm$^2$. Carbon fibres are used primarily in applications calling for a light material with good mechanical properties. Thus the fibres are used in the aerospace and aeronautic industries, particularly in supporting panels, frames, aerial supports for satellites, blades of the main rotor or tail rotor or transmission shafts of helicopters or, finally, in strategic missiles.

Carbon fibres may be manufactured, at the present time, either by carbonisation and/or graphitisation of polyacrylonitrile (PAN), or by stretching fibres with more modest properties derived from cellulose, coal tars, coal extracts or petroleum products at a rate of elongation of the order of 100% or over and at a temperature of the order of 2,500° C.

In either case, the cost of the fibres is high, because of the cost of the raw material and the low yield of fibres. The quality is also low having regard to the complex treatments required to produce the fibres.

Lower cost fibres are also known possessing, apart from the abovementioned mechanical characteristics, properties of chemical inertia, resistance to heat and electric conductivity. They can be obtained from cellulose, coal pitches, petroleum extracts, or coal extracts. These fibres possess tensile strengths of the order of 50 to 80 kgf/mm$^2$ and Young's moduli of 800 to 8000 kgf/mm$^2$.

Processes for the preparation of such fibres are described in British Pat. No. 1,071,400 which describes a process using, as raw material, an organic material which is derived from synthetic organic substances (for example synthetic high polymers such as polyvinyl chloride or polyacrylonitrile) by treatment under an inert atmosphere at 300° to 500° C.

British Pat. Nos. 1,091,890, 1,208,894 and French Pat. Nos. 2,052,112, 2,087,413 and 2,067,619 describe related processes in which, however, the raw material has been previously converted to facilitate the spinning process and increase the mechanical properties of the fibres. Such processes include, particularly, the incorporation of sulphur, polymers such as polyethylene and polystyrene, plasticisers such as castor oil, or alkylated and sulphided derivatives.

British Pat. No. 1,208,194, French Pat. No. 2,113,351 and French patent application No. 70,31,246 describe processes using raw materials which have been treated previously with a solvent so as to extract the most volatile products prior to spinning. The solvents may be, for example, acetone, hexane, toluene or quinolein. French patent application No. 71,45,893 describes a process in which the raw material, which may be asphalt, bitumen, a coal pitch or tar or a petroleum pitch, is extruded into fibres which are then treated in the liquid phase with a nitric acid solution. Such processes, however, have the drawback of requiring supplementary treatment operations in the liquid phase and washing, which may affect the final quality of the fibre.

Finally, French Pat. Nos. 2,178,193, 2,204,571, 2,253,852 and 2,296,032 describe processes for the preparation of carbon fibres from a pitch which has been converted partly into liquid crystal or into the mesophase state. However, such processes use a treatment of the pitch prior to the spinning which may be long and difficult to control.

A distinction has generally been drawn between fibres known as carbon fibres and those known as graphite fibres, a distinction which does not take into account the real crystalline structure of the fibre. Thus, for example, SCHMIDT and JONES in "Carbon-base Fiber Reinforced plastics: AFML, WPAFB, Dayton Ohio, ASD-TDR-62-635 August 1962" classify the fibres according to the end temperature of treatment. Thus it is considered that up to 900° C. the fibres are carbonised or partially carbonised and that they are therefore carbon fibres, whereas between 2000° and 3000° C. they are regarded as completely graphitised. In the case of carbonised fibres, the carbon content is in the vicinity of 98%, whereas in the case of graphite fibres, the content exceeds 98 to 99%. A graphitised fibre is thus defined as a fibre which has been treated at a very elevated temperature and which has a very high content of elemental carbon even when it is prepared from a precursor which does not ensure graphitisation and when it may not have any three-dimensional crystalline structure which is characteristic of polycrystalline graphite.

The Applicants have now discovered a process which makes it possible to prepare carbon or graphite fibres using a raw material derived from petroleum pitches. The raw material is capable of being spun and treated in a simple and not very costly manner.

One object of the present application is, therefore, a process for the preparation of carbon or graphite fibres from a petroleum pitch.

The fibres resulting from this treatment are also included within the invention.

Other objects of the present application will be seen from the description which follows, as well as the Examples illustrating them.

The process for the preparation of carbon or graphite fibres according to the present invention is characterised in that a petroleum pitch having a content of $\beta$ resins of between 5 and 40% is spun into fibres at a temperature higher than the softening point, the fibres being then subjected to a carbonisation by heating, followed if desired by graphitisation.

The petroleum pitches used in the process as defined above preferably contain 10 to 30% of $\beta$ resins. These pitches also, according to the invention, may have a content of $\delta$ resins of between 10 and 20%.

The softening point of the pitches used according to the Invention is preferably between 150° and 250° C. and in particular between 180° and 250° C.

These pitches may be prepared according to known processes such as the process described in the French patent application filed by the applicants under French patent application No. 73,40,152, a process according to which a steam cracking residue of a petroleum fraction is subjected to a distillation followed by a thermal ageing.

This process comprises distilling a steam cracking residue of a petroleum fraction, particularly a naphta fraction, until the pitch reaches a softening point of between 55° and 90° C., and then ageing this pitch until it reaches a softening point of between 85° and 110° C. The ageing temperature is preferably between 350° and 450° C. The pitch thus obtained, however, still contains some volatile products which it is best to eliminate so as to facilitate the operation of spinning as well as the subsequent treatments of the fibres.

These pitches consist in the main of polycondensed aromatic derivatives having widely varying molecular weights, their extent of aromaticity being higher than 96%. They contain different resins, which may be defined by extraction with various solvents in the following manner α resins which are products which are insoluble in quinolein or in an anthracene cut, β resins which are products insoluble in toluene or benzene but soluble in quinolein or anthracene oil, γ resins which are products insoluble in n-hexane but soluble in toluene or benzene, δ resins which are products soluble in n-hexane, benzene and toluene.

The behaviour of these different resins during their carbonisation is different. The rate of polycondensation increases on going from the δ resins to the α resins. The result of this is that the amount of carbon obtained after treatment at high temperature also increases when passing from the δ resins to the α resins.

The products from these resins are also different. Thus, the δ and γ resins as well as the crude pitch give rise to the formation of graphitised products, whilst the α and β resins do not form graphitised products. This may be explained by the fact that the conversion of the α and β resins into coke does not go through an anisotropic liquid phase whereas, on the other hand, the pitch and also the δ and γ resins form a liquid phase known as mesophase which gives rise to the formation of graphitised products.

The δ and γ resins, because of their properties, act as a matrix in relation to the α and β resins.

For the purposes of the present Invention, the proportion of β resins (which is directly connected to the Conradson carbon content determined by NFT method 60116) has to be fairly high in order to permit of a good rigidity of the fibres during the subsequent thermal treatments on the one hand, and obtaining fibres in good yield and with good mechanical properties on the other. The quantity of β resins, however, must not be too large because the thermal treatment of the fibres at high temperature, particularly higher than 2500° C., would not convert the fibres into a polycrystalline graphite structure. With too high a content of β resins, a separation of phases may also occur, leading to a heterogeneous pitch which is difficult to spin.

The pitches of petroleum origin, and in particular those prepared by the process described in the Applicants' French Pat. No. 73,40,152, may therefore be treated in such a way as to give products containing, as stated above, a percentage of β resins which may range up to 5 to 40% and more particularly between 10 and 30% and a content of δ resins of between 10 and 20% by weight. The pitches are modified by a supplementary thermal treatment which increases their Kraemer-Sarnow softening point, determined according to NFT method 6700 1, whilst avoiding a greater condensation of the resins. This thermal treatment makes it possible to concentrate β resins in the medium and to eliminate a part of the light products, such as the δ resins, which may cause difficulties during the subsequent thermal treatments.

The supplementary thermal treatment, however, must be carried out in such a way that the products with a lower molecular weight, which serve as fluxes and binders for the resins are not completely eliminated. The formation of a macromolecular substance which could not be spun correctly in the molten state is thus avoided. Furthermore, the elimination of too large a quantity of light products would considerably increase the softening point of the material to be spun, and consequently the spinning temperature. Too high spinning temperatures are desirably avoided because such temperatures would risk bringing about a thermal conversion of the pitch, which would lead to fibres having an irregular diameter. The δ resin content must for this reason be between about 10 and 20 percent by weight.

The thermal treatment to remove a part of the light products can be carried out in various ways.

It is possible to continue the thermal ageing mentioned above until a pitch possessing the softening points and the resin contents mentioned above is obtained.

Alternatively, the pitch may be stripped with an inert gas (eg. nitrogen, argon or helium), at temperatures lower than 350° C. and preferably at a temperature lower than 300° C. This treatment avoids the additional formation of more highly condensed resins.

Another treatment may be distillation in vacuo at a pressure less than 5 to 10 mm of mercury and at temperatures below 350° C.

The thermal treatment eliminates a part of the light products, as shown by a narrowing of the distribution curve of number average molecular weights ($\overline{M}n$), without an appreciable increase in the weight average molecular weight ($\overline{M}w$).

A thermal treatment carried out at a temperature lower than the cracking temperature of the carbonaceous products also has the advantage that there is no formation of new products of low molecular weight nor any recondensation of the molecules.

The pitches thus obtained are particularly suitable for spinning in the molten state since they possess the abovementioned content of β and δ resins, KS softening points of between 150° and 250° C. and more particularly between 180° C. and 250° C.

These treatments can be carried out rapidly in the space of a few hours, with yields of final pitch in excess of 75%.

It is possible also, at this stage of the operation, to increase the proportion of β resins in the initial pitch by a mild ageing of the raw material at temperatures in the region of 380° C.

The resultant pitches have a rheological behaviour suitable for spinning and drawing into fibres. In fact, the pitch behaves as a Newtonian fluid, its flow through the die being uniform and regular. Too large a quantity of resins in the pitch would produce a colloidal solution of macromolecules of high molecular weights which would not be spinnable.

The treatment of the petroleum residues as defined above also make it possible to eliminate a large part of the α resins (which are insoluble in quinolein) which can form a second solid phase and which can, at the moment of drawing, give rise to stresses at the outlet from the die. This, in turn, may reduce the mechanical strength of the filament and give rise to irregularities.

The content of $\alpha$ resins may be less than 1% and is, preferably, less than 0.2%.

Another advantage of the use of these pitches for producing carbon fibres, lies in the fact that they only contain carbon and hydrogen. Coal tar pitches also contain sulphur, nitrogen and oxygen, which are detrimental to the quality of the fibres.

The raw material thus obtained containing between 5 and 40% of $\beta$ resins and, preferably, 10 to 20% of $\delta$ resins and less than 1% of $\alpha$ resins, is then subjected to treatments which are in themselves known for the production of carbon fibres, consisting in spinning the product in the molten state, oxidising the fibres to render them partially infusible, carbonising the resultant fibres and if desired graphitising them.

The spinning of the pitch is carried out by classic techniques, for example, by normal melt spinning, by centrifugal spinning, by spinning with simultaneous gas blowing etc. The temperature of spinning depends upon the temperature at which the pitch has a suitable viscosity. This temperature depends particularly on the softening point of the pitch and its viscosity; for example, pitches containing approximately 30% of $\beta$ resins having a softening point of 150° C., have a viscosity of about 60 poises at a spinning temperature of 250° C., whereas pitches containing 35% of $\beta$ resins and having a softening point of 180, have a viscosity of about 600 poises at a temperature of 280° C.

The fibres are preferably spun from pitches such as those defined above at a rate of about 60 m per minute to about 1500 m per minute, preferably 60 to 900 m per minute, within a viscosity range of between 60 poises and 600 poises.

When spinning the product in the molten state, the fibres obtained have a variable diameter of between 10 and 50 $\mu$. This diameter may vary according to the draw-off rate (which is the ratio between the diameter of the fibre and the diameter of the thread as it leaves the die) and the feed rate (which also depends on the viscosity of the product and therefore on the spinning temperature, the pressure and the diameter of the die). One may thus decrease the diameter of the fibre by increasing the rate of draw-off or by decreasing the feed rate. However, the spinning temperature must not be too high (because in such a case the viscosity would be too low and would cause liquid flow in the fibres) nor must it be too low (because in this case the product would become too viscous and could not be suitably drawn).

The fibres may then be subjected to an oxidation treatment to render the surface layer infusible, thus making it possible to treat them subsequently at high temperature without the risk of the fibres adhering to or fusing with each other.

The temperature at which this oxidation treatment is carried out should, clearly, not exceed the temperature at which the fibres soften or undergo distortion.

In general, the temperature may be in the range of 100° to 250° C., preferably 150° to 250° C.

The maximum temperature which can be used depends on the pitch used to obtain the fibres and, therefore, on the content of $\beta$ resins, $\delta$ resins and its softening point.

In the case of pitches having a softening point of between 180° and 200° C., the thermal treatment should use a maximum temperature of 250° C. Above this temperature, the oxidised layer becomes unnecessarily thick and reduces the mechanical properties of the fibres. Below 250° C. the rate of oxidation may be insufficient and the fibres may have a tendency to stick to one another during the high temperature treatments, even if rates of increase of temperature are very low, eg. the order of 0.5° C. per minute.

This oxidation treament may be carried out in the presence of air or a gaseous oxidising agent (eg. oxygen or ozone). The fibres should be sufficiently separated during this treatment so that there is practically total contact of the surface of the fibres with the air or the gaseous oxidising agent during the entire period of treatment. The stream of gas over the fibres, in addition to giving surface oxidation, should also eliminate all the reaction products from the surface of the fibres.

The oxidation treatment may be carried out with a rate of increase in temperature which is relatively slow, thus helping to ensure a complete treatment. Programmes of temperature increase which are particularly satisfactory for the treatment of the pitches according to the Invention may, for example, be as follows: between 0° and 120° C., the rise in temperature may be rapid, while between 120° C. and 250° C. the rise in temperature may be slow, eg. a rate of between 30° to 60° C. per hour.

The rate of flow of gas influences the final mechanical properties of the fibres and the yield. This rate of flow should be sufficient to allow a suitable degree of oxidation, to eliminate the last traces of so-called volatile products, and to avoid the adhesion of the fibres to one another. This rate of flow should, however, not be too high because this would give too great an oxidation and therefore a reduction in the mechanical properties of the fibres. The rate of flow of oxidising gas, and more particularly of air, may therefore vary between 2 liters per hour and 50 liters per hour and in particular between 10 liters per hour and 30 liters per hour.

The carbonisation of the surface-oxidised fibres is carried out by heating (eg. from 500° to 2500° C.) under an inert atmosphere, eg. a flowing stream of nitrogen, argon, hydrogen or helium. During the course of this treatment the fibres are freed from their lightest constituents, which are carried away in the stream of carrier gas. Moreover, at a temperature of between 400° and 450° C., condensation occurs, giving a progressive conversion of the structure and a carbon product containing at least 98% of carbon. For this reason it is particularly important during the carbonisation treatment to control accurately the rate of increase of temperature, and avoid a too rapid removal of light products which could cause cracks in the fibres.

One particular aspect of the Applicant's process is the use, during the carbonisation stage, of a rate of increase of temperature which is very slow between 400° and 450° C., during which the pitch is converted into a mesophase. This slow temperature stage during the carbonisation process favours the orientation of the crystallites and consequently increases the mechanical strength of the treated fibres. This treatment also makes it possible to improve the yield of the fibres. A yield of fibres of 100% can be obtained after a treatment at 400° C. and of 85% after a treatment at 500° C., for pitches with a softening point of 180° C.

A particularly preferred carbonisation treatment may be as follows. Between 250° and 400° C. there is a rapid rate of increase of temperature which may be between about 60° and 300° C. per hour; between 400° and 450° C. the rate of increase of temperature is low and it is preferably between about 30° and 60° C. per hour, while between 450° and 1000° C. the rate of increase of temperature is very rapid and is between about 300° C. per hour and 600° C. per hour.

The rate of increase of temperature may vary according to the nature of the initial pitch. Thus, the higher the softening point of a pitch, the higher will be the rate of increase and consequently the shorter will be the treatment times. By way of example, a pitch having a softening point of about 180° C. may be carbonised in about 10 hours.

As for the oxidation treatment, the rate of flow of carrier gas during carbonisation should be chosen in such a way that it is possible to carry away the different products of carbonisation at rates such that the structure of the fibres is not adversely affected. For fibres carbonised at 1000° C. it is possible to eliminate completely the small quantity of hydrogen by an additional high-temperature treatment. This treatment is preferably carried out between 2000° and 2500° C. and it acts to increase the Young's modulus of the fibres.

Graphitisation, if required, is carried out by a treatment at temperatures higher than 2500° C. The process is usually carried out in a very rapid manner, eg. for only 1 to 10 minutes.

The carbonised fibres may have mechanical strengths varying between 30 and 80 kg/mm$^2$ for diameters of fibres ranging from 20 to 40μ and the elongation at break may be approximately 2%. For a carbonisation treatment carried out at 1000° C. under tension, the mechanical strength of the fibre and particularly the Young's modulus are increased with a reduction in the elongation at break.

The invention is illustrated by the following Examples:

EXAMPLE 1

A pitch from a steam cracking residue was used as the raw material. The pitch was prepared from a residue from the steam cracking of naphtha having the following properties:

| | |
|---|---|
| density at 25° C.: | 1,056 g/cm$^3$ |
| viscosity at 50° C. (cst): | 40 |
| viscosity at 100° C. (est): | 6.9 |
| flash point (°C.): | 105 |
| Conradson carbon (% by wt.): | 12 |
| Sulphur (% by wt.): | 0.11 |
| ASTM distillation: | Initial boiling point (°C.): 108<br>10% by vol. (°C.): 218<br>50% by vol. (°C.): 259 |

The naphtha fraction had a density of 0.710, and the following distillation properties: an initial boiling point higher than 35° C., a final boiling point lower than 180° C. and a sulphur content lower than 0.15 percent by weight. The residue was distilled under atmospheric pressure discontinuously until a KS softening point of 60° C. was reached. This pitch was then aged by heating under reflux for 3 hours at 360° C. until its KS softening point reached 92° C. In A product was obtained having the following properties:

| | |
|---|---|
| density at 20° C.: | 1.21 |
| KS softening point (°C.): | 92 |
| β resins (% by wt.): | 22 |
| α resins (% by wt.): | less than 0.2 |
| Conradson carbon (% by wt.): | 50 |
| atomic ratio C/H: | 1.36 |
| viscosity at 160° C.: | 4500 cps |
| 180° C.: | 860 cps |
| 200° C.: | 220 cps |

The yield based on the steam cracking residue was 38%. This pitch was then redistilled in vacuo at a pressure of less than 1 mm of mercury, up to a maximum temperature of 300° C. During this treatment 26% of the products were eliminated, that is to say a yield of 74% in relation to the first pitch. The properties of the final pitch were as follows:

| | |
|---|---|
| density at 20° C.: | 1.23 |
| KS softening point (°C.): | 183-185 |
| β resins (% by wt): | 32 |
| α resins (% by wt.): | less than 0.2 |
| γ resins (% by wt.): | approx. 48 |
| δ resins (% by wt.): | approx. 20 |
| Conradson carbon (% by wt.) | 63.6 |

This pitch was then ground and screened using a screen having apertures of 150μ, then melted and filtered before being placed in an extrusion cylinder. After de-gassing for 1 hour it was drawn into fibres by the application of a gas pressure (nitrogen so as to avoid oxidation) at a temperature of 250° C.

The molten pitch was extruded through orifices with a diameter of 250μ, situated in the bottom of the cylinder, and the fibres were drawn and wound on to a drum, the speed of winding being variable. In this way a quantity of fibres with diameters of 18 to 40μ were produced at winding speeds of 60 to 650 m per minute. A part of the drawn fibres were deposited on a graphite plate placed in a tubular furnace and they were heated according to the following programme

| | | |
|---|---|---|
| 0°-120° C.: | 1° C./min. | |
| 120°-250° C.: | 0.5° C./min. | at the rate of 11 l/hr of air |
| 250°-420° C.: | 1° C./min. | |
| 420°-450° C.: | 0.5° C./min. | at the rate of 11 l/hr of nitrogen |
| 450°-1000° C.: | 5° C./min. | |

This programme is shown graphically in the accompanying drawing (Programme 1).

80% of fibres were obtained in this way from a pitch having a KS softening point of 183, of a diameter of 24μ with mechanical strengths of 40 to 50 kgf/mm$^2$ and an elongation at break of 2%.

These fibres may be used as they are in the reinforcement of certain plastic materials.

EXAMPLE 2

The same pitch from a steam cracking residue having a KS softening point of 90 was used as in Example 1, except that a larger quantity of volatile products was distilled off. The properties of the pitch obtained were as follows:

| | |
|---|---|
| KS softening point: | 205°-210° C. |
| density: | 1.23 |
| α resins (% by wt.): | less than 0.2 |
| β resins (% by wt.): | 36% |
| insolubles in hexane: | 86 |
| γ resins (% by wt.): | 50 |
| δ resins (% by wt.): | 14 |
| Conradson carbon: | 67.4% |

The pitch thus obtained was spun in the molten state using the same apparatus as that used in Example 1. Pitch fibres of a mean diameter of 35μ were obtained. These fibres were divided into two batches. The first batch, called Batch A, was treated thermally as in Example 1 up to 1000° C. using the same programme of rise of temperature. The yield of fibres obtained was 85%. The tensile strength was 60 kgf/mm² for diameters of 33μ.

The second batch, called Batch B, was treated differently according to a programme of rise of temperature which was much more rapid, i.e.

| | | |
|---|---|---|
| 0°-150° C. | 2° C./min. | at the rate of 11 1/hr of air |
| 150°-250° C. | 0.5° C./min. | |
| 250°-1000° C. | 5° C./min. | at the rate of 11 1/hr of nitrogen |

This programme is also shown graphically in the accompanying drawing (Programme 2).

The time of treatment was 7 hours as against 12 hours for the first batch. In this case, the yield of fibres was 85% and the mechanical strength was 60 kgf/mm² for a diameter of 33μ.

EXAMPLE 3

A pitch having a KS softening point of 183° to 185° C. was spun to produce regular and homogenous fibres with a diameter of 21μ.

The fibres obtained were treated at 1000° C. under the same conditions as those set out in Example 1. These fibres were then divided into three batches. The first batch was treated at 1500° C. for 1 hour. The second batch was treated at 2000° C. for 1 hour and the third batch was treated at 2500° C. for 1 hour.

The increase in the Young's modulus with increasing temperature of treatment of the fibres is shown in the following table:

Table 1

| Fibres | R kgf/mm² | % elongation | E kgf/mm² |
|---|---|---|---|
| Fibres treated at 1000° C. | 20 | 0.7% | 3000 |
| Fibres treated at 1500° C. | 30 | 0.7% | 3000 |
| Fibres treated at 2000° C. | 25 | 1% | 4000 |
| Fibres treated at 2500° C. | 25 | 1% | 4500 |

EXAMPLE 4

The conditions of spinning of Example 3 were repeated but this time the pressure of spinning was varied as well as the speed of take-up, to give fibres of different diameters. The different batches of fibres were treated in the same way as in Example 1. The tensile strengths were as follows:

Table 2

| Diameter of fibres (μ) | R kgf/mm² |
|---|---|
| 60 | 8 |
| 30 | 13 |
| 25 | 17 |
| 22 | 30 |
| 20 | 60 |

We claim:

1. Process for the manufacture of carbon or graphite fibres from petroleum pitch comprising spinning the said pitch into fibres at a temperature higher than the softening point of the pitch and carbonising the resultant fibres by heating, characterised in that a petroleum pitch is used having a β resin content of between 5 and 40%, a δ resin content of between 10 and 20% and a α resin content of less than 1%, said pitch being further characterised by the fact that the said pitch is prepared by subjecting a steam cracking residue of a petroleum fraction to a distillation to obtain a pitch having a KS softening point of between 55° and 90° C., and ageing the pitch thermally until a softening point of between 150° and 250° C. is obtained.

2. Process in accordance with claim 1, characterised in that the β resin content of the said pitch is between 10 and 30%.

3. Process in accordance with claim 1, characterised in that the pitch prepared by subjecting a steam cracking residue of a petroleum fraction to a distillation to obtain a pitch having a KS softening point of between 55° and 90° C., is aged thermally until a softening point of between 85° and 110° C. is obtained and then the pitch thus obtained is subjected to a supplementary thermal treatment to obtain the pitch having a softening point of between 150° and 250° C.

4. Process in accordance with claim 3, characterised in that the said supplementary thermal treatment is carried out by stripping with an inert gas at a temperature lower than 350° C.

5. Process in accordance with claim 4, characterised in that the said supplementary thermal treatment is carried out in the presence of nitrogen or argon and at a temperature lower than 300° C.

6. Process in accordance with claim 3, characterised in that the said supplementary thermal treatment is carried out by distillation in vacuo at a temperature lower than 350° C.

7. Process in accordance with claim 6, characterised in that the said distillation in vacuo is carried out at a pressure lower than 5 to 10 mm Hg.

8. Process in accordance with claim 1, characterised in that the temperature of spinning is chosen so that the pitch has a viscosity between about 60 poises and 600 poises.

9. Process in accordance with claim 1, characterised in that between the stages of spinning and carbonisation an oxidation of the fibres is carried out in the presence of an oxidising gas.

10. Process in accordance with claim 9, characterised in that the oxidation temperature is not more than 250° C. for fibres from a pitch having a softening point of between 180° and 200° C.

11. Process in accordance with claim 9, characterised in that the oxidising gas is oxygen, ozone or air.

12. Process in accordance with claim 9, characterised in that the rate of flow of oxidising gas varies between 2 liters per hour and 50 liters per hour.

13. Process in accordance with claim 1, characterised in that the carbonisation is carried out under an inert atmosphere.

14. Process in accordance with claim 13, characterised in that the carbonisation is carried out in the presence of a gas selected from among nitrogen, argon, hydrogen, helium.

15. Process in accordance with claim 13, characterised in that the carbonisation is carried out at a rate of increase of temperature of between 60° and 300° C. per hour between 250° and 400° C., at a rate of between 30° and 60° C. per hour between 400° and 450° C. and at a rate of increase of temperature between 300° and 600° C. per hour between 450° and 1000° C.

16. Process in accordance with claim 1, characterised in that the carbonisation is followed by a high-temperature thermal graphitisation treatment at between 2000° and 2500° C.

17. Process in accordance with claim 1, characterised in that the graphitisation treatment is for a period of 1 to 10 minutes.

18. Process in accordance with claim 9, characterised in that the oxidation treatment is carried out at a rate of increase of temperature of 30° to 60° C. per hour between 120° and 250° C.

19. Process in accordance with claim 14, characterised in that in the carbonisation treatment, a stage of increase of temperature is incorporated which is between 30° and 60° C. per hour between 400° and 450° C.

* * * * *